US006431146B1

(12) United States Patent
Alexius et al.

(10) Patent No.: US 6,431,146 B1
(45) Date of Patent: Aug. 13, 2002

(54) FREE PISTON ENGINE AND SELF-ACTUATED FUEL INJECTOR THEREFOR

(76) Inventors: Richard C. Alexius, deceased, late of Orlando, FL (US); by Karl R. Alexius, Executor; by Renee S. Alexius, Executrix, both of 5680 Suncreek Ct., Orlando, FL (US) 32839

( * ) Notice: Subject to any disclaimer, the term of this patent is extended or adjusted under 35 U.S.C. 154(b) by 0 days.

(21) Appl. No.: 09/984,415

(22) Filed: Oct. 30, 2001

Related U.S. Application Data

(62) Division of application No. 09/500,468, filed on Feb. 9, 2000.

(51) Int. Cl.[7] ..... F02M 41/00
(52) U.S. Cl. ..... 123/451; 239/88; 123/448
(58) Field of Search ..... 123/473, 451, 123/447, 448, 46 R; 239/88

(56) References Cited

U.S. PATENT DOCUMENTS

| | | | | | |
|---|---|---|---|---|---|
| 1,615,133 | A | | 1/1927 | Pescara | |
| 2,434,280 | A | | 1/1948 | Morain | |
| 3,501,087 | A | | 3/1970 | Benaroya | |
| 3,851,635 | A | * | 12/1974 | Murtin et al. | 123/448 |
| 4,167,168 | A | | 9/1979 | Yamamoto | |
| 4,245,589 | A | | 1/1981 | Ryan | |
| 4,250,857 | A | * | 2/1981 | Taplin | 123/448 |
| 4,292,947 | A | | 10/1981 | Tanasawa et al. | |
| 4,556,037 | A | * | 12/1985 | Wisdom | 123/451 |
| 4,615,322 | A | * | 10/1986 | Dazzi | 123/451 |
| 4,873,822 | A | | 10/1989 | Benaroya | |
| 5,507,260 | A | * | 4/1996 | Hintzen | 123/451 |
| 5,718,385 | A | | 2/1998 | Fontell | |
| 5,865,157 | A | * | 2/1999 | Romanelli et al. | 123/451 |

* cited by examiner

*Primary Examiner*—Carl S. Miller
*Assistant Examiner*—Jason Benton

(57) ABSTRACT

A simple propulsion engine utilizing unheated atmospheric air as the propellant, and driven by a single cycle (unicycle) engine with internal combustion cylinder and free piston is disclosed. A free piston with an annularly arranged thrust piston to divide a dual-diameter cylinder into two combustion chambers and two thrust chambers is provided. Scavenge feeder lines connected the thrust chambers to the combustion chambers via check valves provide exhaust scavenging, additional thrust output through exhaust nozzles, and feeding of fresh air into the combustion chambers. Also, pressure-actuated fuel injectors utilize pressure changes in respective combustion chambers to inject fuel at the appropriate time. The fuel injector includes an intensifier piston and pintle to raise the fuel pressure.

7 Claims, 14 Drawing Sheets

(REVERSE THRUST)

(TANDEM)

FREE PISTON ENGINE AND SELF-ACTUATED FUEL INJECTOR THEREFOR

This Application is a divisional of co-pending application Ser. No. 09/500,468, filed on Feb. 9, 2000, the entire contents of which are hereby incorporated by reference.

BACKGROUND OF THE INVENTION

1. Field of the Invention

This invention is in the field of propulsive machines cooperating with internal combustion, free piston engines and compressors to produce motive power, lifting, or other uses. This invention also relates to a self-actuated fuel injector that may be utilized in such an engine.

2. Background of the Invention

Numerous inventions known in the prior art have been developed, and many proposed which are based on the Newtonian principle of reactive propulsion. Propellers and helicopter rotors, jet engines, and rockets are the principal examples of that genre.

Propellers and rotors, however, require complex internal combustion or gas turbine engines to supply rotating torque to airfoil shaped blades. Large amounts of unconstrained, low pressure air is propelled aftward of the propeller/rotor due to the lift and screw action of the airfoil shaped blades, creating thrust and invoking the concomitant slip, drag, and kinetic energy air stream losses. The total fuel efficiency of these systems is determined primarily by the engine and propeller inefficiencies. In the present invention, there are no propeller losses, and engine losses and engine weight are minimized by the elimination of piston rods, crankshafts, flywheels, transmissions, and, in the case of turbines, high soak temperature turbine blading, adjunct compressors, and internal flow losses.

Chemical thermal-jet engines utilize ram air and axial flow or centrifugal compressors to force air into an engine inlet and raise its pressure in a combustion chamber. In the combustion chamber, fuel is injected and burned creating high temperature, high velocity gases. Part of the gas velocity energy is used up driving turbine blades for the compressor, and the gas then exits a nozzle to produce thrust. Large thermal losses are incurred due to the extreme temperatures at which the jet engine must operate. Rocket engines carry fuel and oxidizer internally and generate their propulsive gasses from within.

Free piston internal combustion engine and compressor combinations are well known, and the prior art contains many examples of various concepts and configurations. None were found which incorporates a power stroke at each end of a single cylinder and uses an unadorned, simple piston whose only functions are to separate the combustion and compression chambers and provide inertial energy storage. Free piston engines and compressors disclosed in the literature are complex and heavy devices which go to great lengths to counteract cylinder reaction to the acceleration of the piston(s) by the use of elaborate spring-counterweight mechanisms or tandem pistons synchronized by rack and pinions, linkages, gears, or other mechanical means.

However, there are no feasible, chambered high pressure propulsion systems that utilize unheated atmospheric air, on a continuous basis, as the main propellant medium. The reason for this is undoubtedly the difficulty of conceiving an engine and compressor combination that is simple and lightweight enough to make it practical.

SUMMARY OF THE INVENTION

The present invention involves a major change in the concept of vertical lifting and locomotion in each of the primary modes of land, air, and marine propulsion. As a necessary prerequisite to invention of the atmospheric propulsion engine, the unicycle free piston engine was invented as described herein. The combination of atmospheric air propellant and unicycle free piston engine are part of the unique and defining elements of the present invention.

The single cycle free piston engine disclosed herein uses a simple lightweight piston which minimizes the reactive movement of the cylinder assembly (this movement being a function of the ratio of piston mass-to-cylinder assembly mass).

This present invention is an atmospheric propulsion engine, firing its free piston at each end of the cylinder, scavenging of exhaust products, and natural self cooling due to the large internal ingestion of atmospheric air.

As an indication of the efficacy of the atmospheric propulsion engine, a simple calculation is presented. A cylinder 1.5 inches in diameter, and 18 inches long contains a volume of 31.8 $in^2$ and has a weight of air equal to 0.0014 lbs. at standard atmospheric conditions. When this mass of air is expelled at 70° F. (520° R), at sonic velocity, in 0.010 seconds through a thrust-producing nozzle, a force of 4.83 lbs. is generated. If this same mass of air is expelled at the temperature and pressure corresponding to a 10 to 1 compression ratio (1300° R and 370 psi), the force generated would be 7.71 lbs.

The atmospheric propulsion engine will produce a thrust (force) somewhere between the above numbers, and a computer simulation of the above configuration indicates that an average thrust of 6.4 lbs. can be achieved. Using aircraft type construction, it is estimated that such a device would weigh about 2.1 lbs., yielding an engine thrust-to-weight ratio of 3-to-1. Based on this evaluation, the atmospheric propulsion engine would be suitable for flying and hovering applications, as well as numerous other uses discussed in the following descriptions.

Note: The above performance calculations are based on the following formulas:

$$\text{Thrust}=\text{Mass of air X Sonic velocity/time}$$

$$\text{Sonic velocity}=\sqrt{kXgXRXT}$$

Where:

k=Ratio of specific heat for air=1.4 g=Gravity constant=386.4 in./$sec^2$

R=Gas Constant=640 in-lb/lb-° F.

T=Temperature ° R

The specific impulse of the above configuration is calculated to be in the 2000 to 4000 lb-sec/lb range using standard automotive gasoline or diesel fuel.

A comparison of existing art with the present invention of the atmospheric propulsion engine reveals the superior characteristics of the concept and method.

This invention directly converts the fuel's thermal energy primarily into mechanical Pressure/Volume (PV) forces, compressing atmospheric air and expelling it at sonic velocity to efficiently generate thrust. The only major moving part in the atmospheric propulsion engine system is the internally shared engine/compressor piston which presents another major advantage of this invention, especially in the case of helicopters, by the elimination of noisy and dangerous external rotating propellers and rotor blades.

In the present invention, most of the fuel's thermal energy is used up in the PV expansion process of the working fluid to drive the piston, thus, after the compressed air propellant is expanded in the thrust nozzles, a relatively cool, benign gas is expelled. No compressor is required as atmospheric pressure is adequate to refill the expulsion gas chamber. However, superchargers, or in applications involving moving vehicles, ram air, can be utilized to raise the compressor inlet pressure, thus enhancing compressor volumetric efficiency and increasing the engine's thrust-to-weight ratio.

Applications for an independent, free standing thrust engine are manifest.

Given a nominal engine thrust to weight ratio of 3 to 1, coupled with the benignity of the exhaust products, it becomes feasible to design and market a personal passenger vehicle which can fly to its destination without having to concern itself with roads, bridges, or other ground based obstacles. This thrust to weight ratio also may make the engine applicable to "backpack" individual flying machines. Steering, stability and control of such flying machines can be accomplished through thrust vector control mechanisms such as movable nozzles or jet vanes as shown in FIGS. 10 and 11, or may be implemented by other well known aerodynamic means available in the existing art.

Much effort has been expended in the quest for reducing weight and increasing the efficiency of automobiles to combat air pollution. An automobile designed using the lightweight atmospheric propulsion engine disclosed herein would preclude the necessity for flywheels, crankshafts, piston rods, cooling systems, transmissions, driveshafts, differentials, and drive axles. This would eliminate the weight, power losses, and thermal inefficiencies due to these components. Probably, 50% or more of an automobile's weight could be eliminated and fuel requirements reduced considerably. In addition, the propulsion drive would make vehicle acceleration independent of tire traction. A passenger car could be designed with forward and rearward facing thruster nozzles to control acceleration and braking (thrust reversal, as shown in FIG. 6), and vectored nozzles could control steering to effect a vehicle which is independent of road and tire friction. Or, a hybrid of conventional braking and steering with propulsive drive could be contrived. These same characteristics apply to travel over water, snow, and ice.

Present ground effect machines (GEM) require substantial amounts of air to create sufficient pressure in the vehicle-to-surface interface plenum with which to support the gravity load and provide sufficient surface clearance. This is normally accomplished by the use of large, noisy, inefficient fans. The present invention could be used to provide partial lift from its propulsion engine(s), while using the nozzle exhaust to pressurize the GEM interface plenum. The small plenum back pressure would have little effect on the nozzle's thrust efficiency.

Aircraft propulsion would benefit from this invention's enhanced engine specific impulse and from the availability of high speed ram air to increase the propulsion chamber's volumetric efficiency, thus minimizing the size and weight of the overall propulsion system. The availability of simple, full engine thrust reversal would greatly increase aircraft braking capabilities and reduce runway rollout.

The atmospheric propulsion engine can be slidably mounted to its structure with a simple centering spring mechanism and allowed to traverse a small distance back and forth as shown in FIG. 8. This engine can also be configured in tandem opposed end-to-end combinations to eliminate reactive engine movement, with synchronization being accomplished by a correct starting procedure, metering of fuel, and timing of the ignition process. FIG. 7 shows schematically how two tandem engines could be configured.

In addition to its use in the atmospheric propulsion engine, the simplicity and lightweight of the single cycle free piston engine disclosed herein is desirable for other engine applications such as air compressors and power tools.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
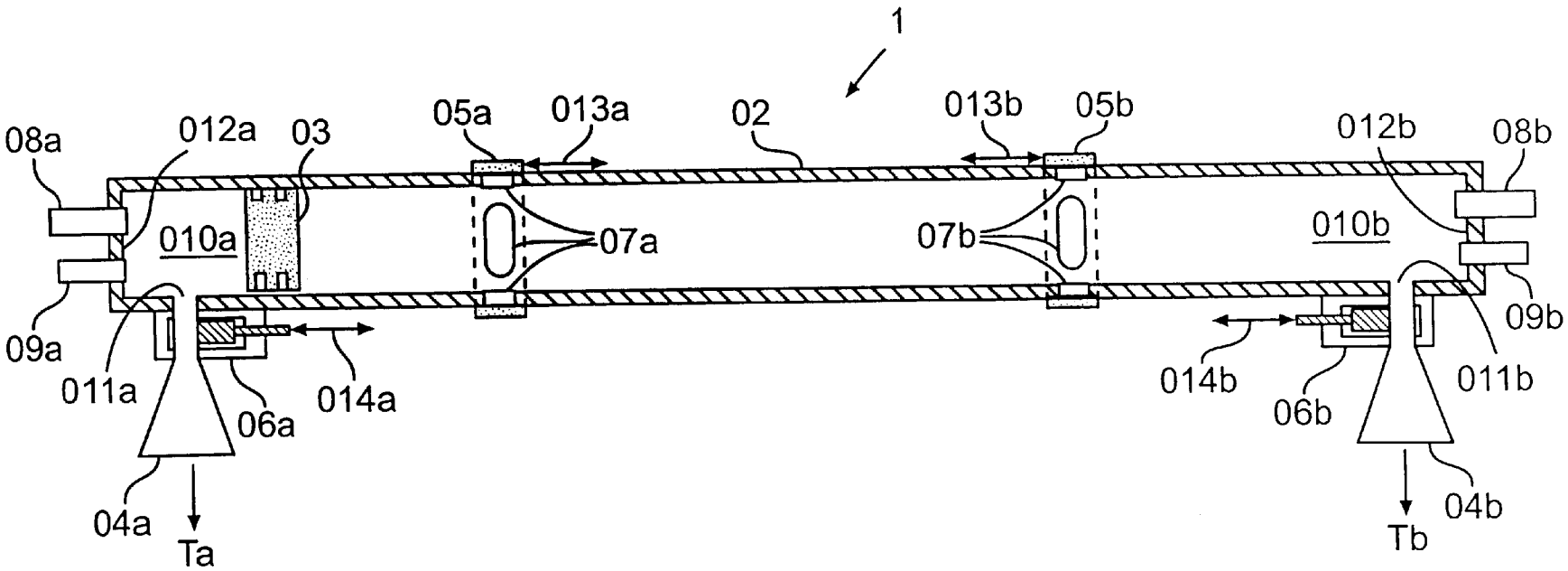
FIG. 1 is a schematic cross section of the atmospheric propulsion engine of a first embodiment made up of the unicycle free piston engine and propulsion components.

The first embodiment of the atmospheric propulsion engine is illustrated schematically in FIG. 1, and generally by reference numeral 1. It is a single-cycle (unicycle), spark ignition engine and compressor having a cylinder 02 with cylinder heads 012*a* and 012*b* on each end and having a piston 03 slidably interposed therebetween, forming alternate combustion and compression chambers 010*a* and 010*b*. Cylinder heads 012*a*, 012*b* contain fuel injectors 08*a*, 08*b* and igniters 09*a*, 09*b*. The engine has thrust nozzles 04*a*, 04*b* with associated valves 06*a*, 06*b* and actuators 014*a*, 014*b* which sense piston 03 obturation of nozzle ports 011*a*, 011*b* to effect appropriate valve, fuel injection, and ignition timing for sustained operation as further explained below.

The engine also has common exhaust/inlet ports 07*a*, 07*b* which perform the dual functions of exhausting combustion gasses and admitting atmospheric air for propulsion, scavenging, and cooling. Exhaust/inlet ports 07*a*, 07*b* are opened and closed by valves 05*a*, 05*b* and-associated actuators 013*a*, 013*b* which sense obturation of exhaust/inlet ports 07*a* and 07*b* and enforce the appropriate valve action of valves 05*a*, 05*b*, 014*a*, and 014*b*.

The valves, actuators, fuel injectors, and igniters for the first embodiment are conventional elements whose description will be omitted here for the sake of brevity.

Figure 2:
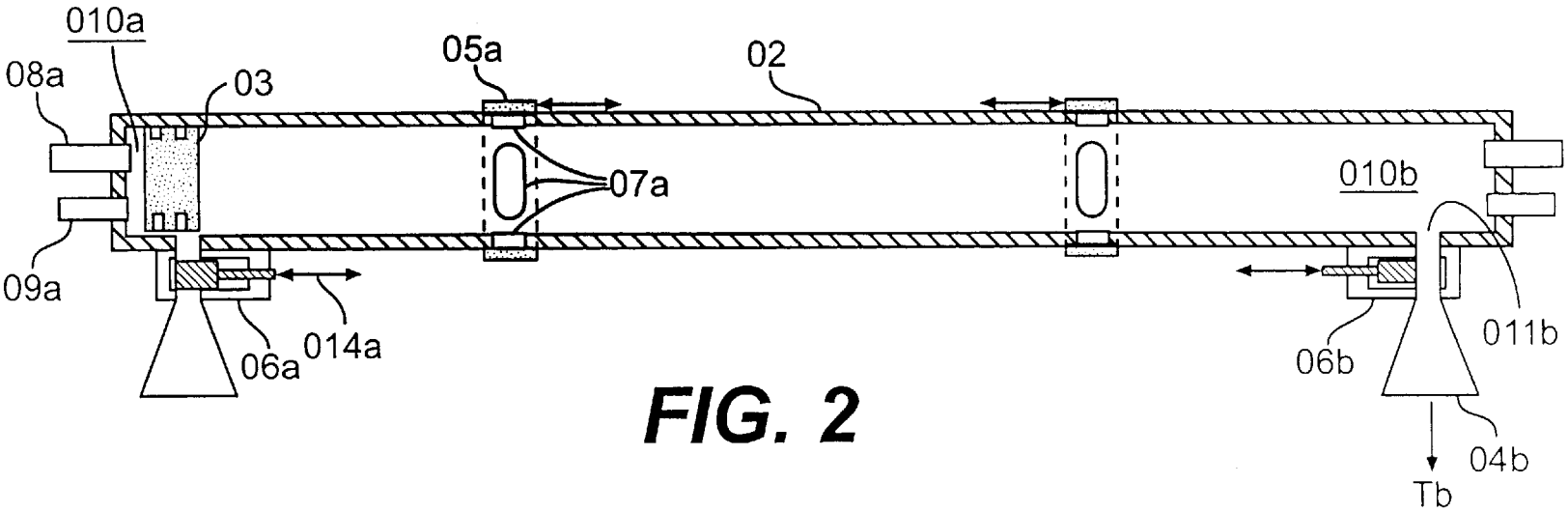
FIG. 2 is the schematic of FIG. 1 with the piston in firing position at the left end of the cylinder.

The operational cycle is defined as follows:

Referring to FIG. 2, piston 03 is positioned in cylinder 02 such that the air charge and fuel mixture in chamber 010*a* is at the required combustion pressure. With piston 03 in this position, igniter 09*a* is energized to initiate combustion in chamber 010*a* and begin the cycle. As further shown in FIG. 2, nozzle valve 6*b* is open, nozzle valve 06*a* is closed, and valves 05*a*, 05*b* are closed at this part of the cycle and piston 03 begins accelerating to the right due to the combustion pressure in chamber 010*a* (dashed line arrows indicate movement).

As piston 03 moves to the right under the impetus of the combustion pressure in chamber 010*a*, the air/exhaust mixture in 010*b* is compressed and expelled through nozzle port 011*b*, open nozzle valve 06*b* and thrust nozzle 04*b*, thus generating the thrust Tb.

Figure 3:
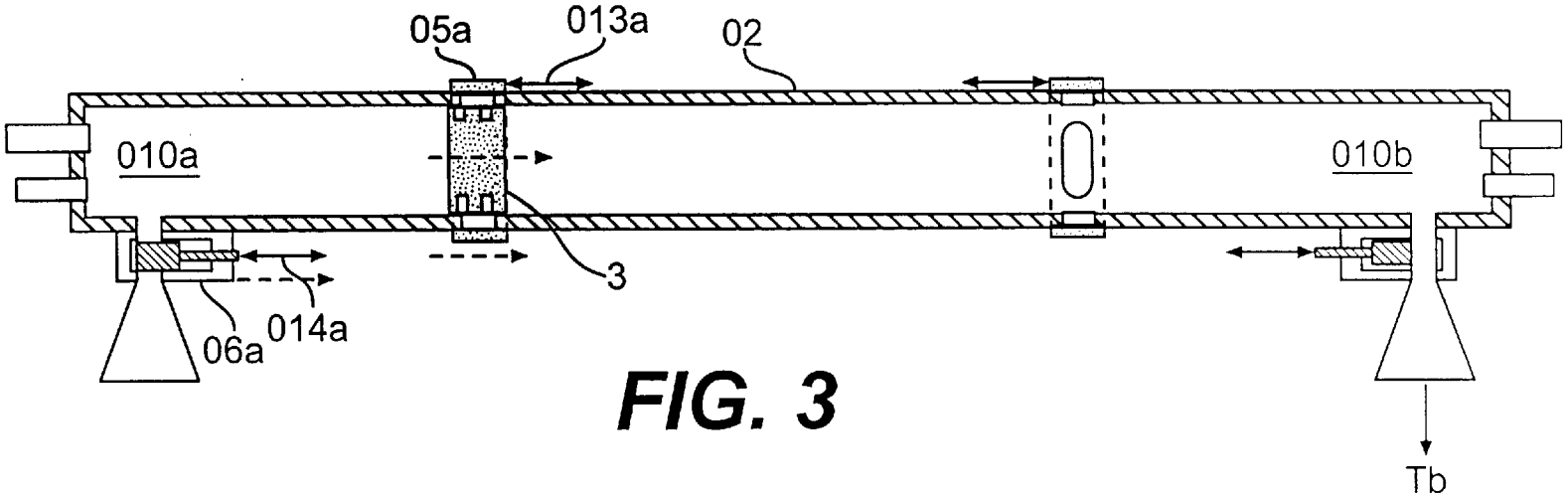
FIG. 3 is the schematic of FIG. 1 with the piston crossing the inlet/exhaust ports at the left-of-center cylinder region.
Figure 4:
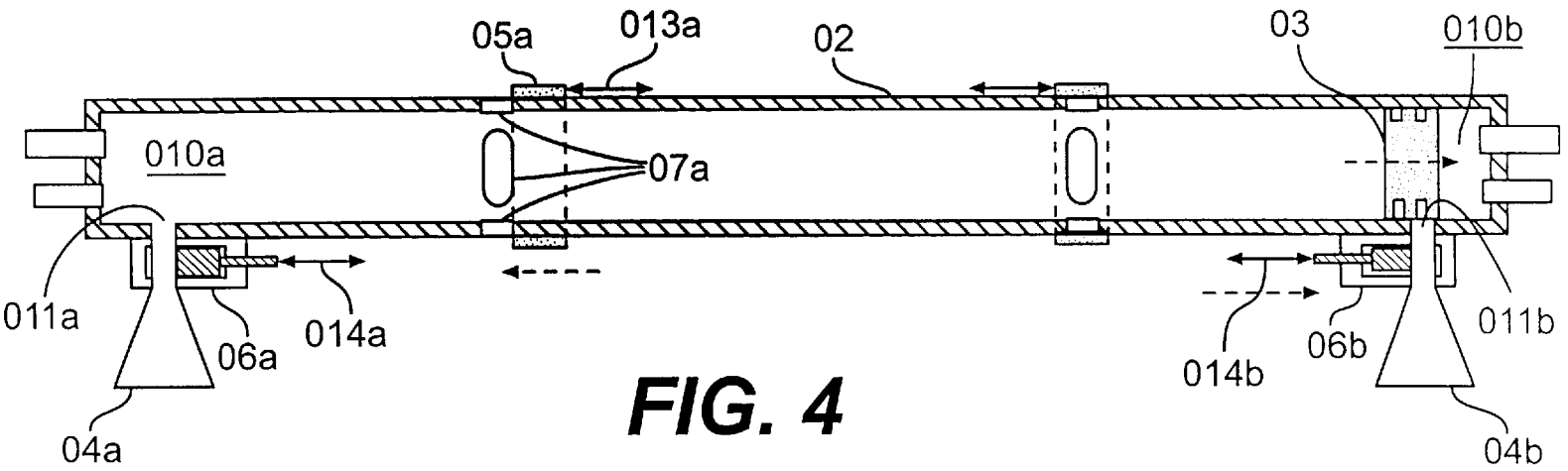
FIG. 4 is the schematic of FIG. 1 with the piston crossing the nozzle port on the right end of the cylinder.

As shown in FIG. 3, when piston 03 crosses exhaust/inlet ports 07*a*, actuator 013*a* senses port 07*a* closure and opens nozzle valve 06*a* and causes actuator 13*a* to open exhaust/inlet port 07*a* via the valve 05*a*. FIG. 4, shows the opened state of nozzle valve 06*a* and exhaust/inlet port 07*a*. At this point, piston 03 reaches its maximum velocity.

The remaining unexpanded low-pressure combustion gasses are then exhausted through exhaust/inlet port 07*a* and nozzle port 011*a*, nozzle valve 06*a*, and thrust nozzle 04*a*. Meanwhile, piston 03 continues to travel to the right in cylinder 02 due to its inertial energy. The continuing rightward movement of piston 03, draws atmospheric air into chamber 010*a* through exhaust/inlet port 07*a* and nozzle 04*a*. Nozzle 04*a* is open at this event time to provide scavenging and dilution of the exhaust products.

The distance between nozzle port 011*b* and cylinder wall 012*b* is prefixed such that the mass of air charge required for subsequent combustion in chamber 010*b* is attained as piston 03 crosses and obturates nozzle port 011*b* as shown in FIG. 4.

Figure 5:
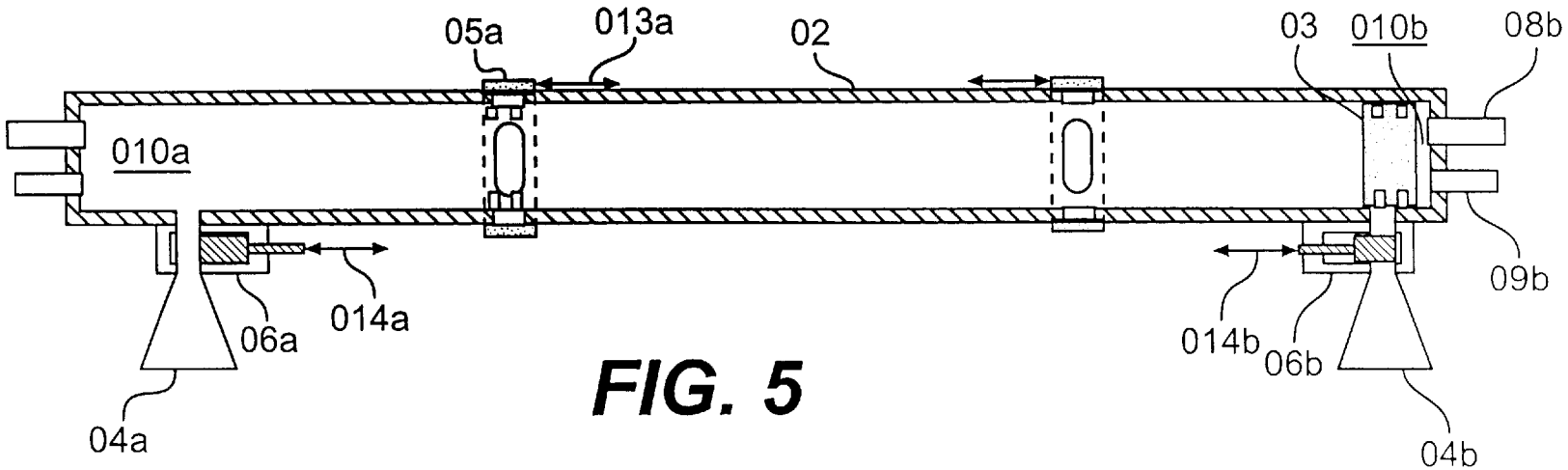
FIG. 5 is the schematic of FIG. 1 with the piston in firing position at the right end of the cylinder.

At this point, the loss of high pressure in port 011*b* sensed by actuator 014*b* initiates five actions, shown in FIG. 4: the actuator 013*a* for slide valve 05*a* closes off exhaust/inlet ports 07*a*; the actuator 014*b* closes nozzle port 011*b*; the injector 08*b* injects a metered amount of fuel into chamber 010*b*; actuator 014*a* for nozzle valve 06*a* opens nozzle port 011*a* to nozzle 04*a*; and a delayed signal is sent to fire the igniter 09*b* when piston 03 achieves maximum compression in chamber 010*b* as shown in FIG. 5. The remaining inertial energy of piston 03 is dissipated in achieving the required combustion pressure in chamber 010*b*.

The atmospheric propulsion engine has completed one cycle and is in position to repeat the next cycle in the opposite direction. The sequence of this next cycle can be followed by substituting the a and b components for one another and reversing the piston's direction.

Figure 6:
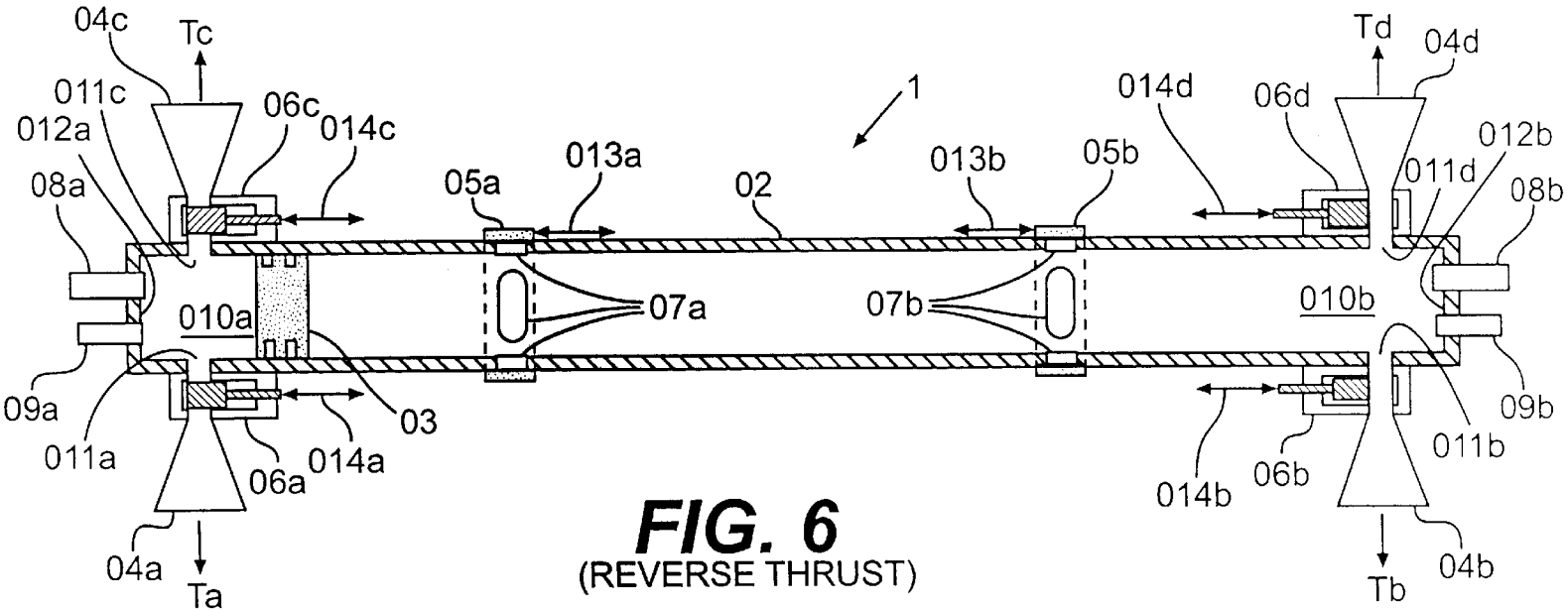
FIG. 6 is the schematic of FIG. 1 showing an engine configuration with discrete thrust reversal nozzles and valving.

FIG. 6 illustrates how the inventive engine can be utilized to generate reverse thrust. Essentially, the thrust assembly including nozzle port, valve, actuator and thrust nozzle is duplicated. Specifically, nozzle port 011*c* is disposed opposite to nozzle port 011*a* and has attached thereto a valve 06*c*, actuator 014*c* and reverse thrust nozzle 04*c*. A corresponding nozzle port 011*d* is disposed opposite to nozzle port 011*b* and has attached thereto a valve 06*d*, actuator 014*d* and reverse thrust nozzle 04*d*. To generate reverse thrust, valves 06*c* and 06*d* would be activated instead of valves 06*a* and 06*b*, but with the same timing relationship as for valves 06*a* and 06*b* described above. The result is the generation of reverse thrust Tc and Td.

Figure 7:
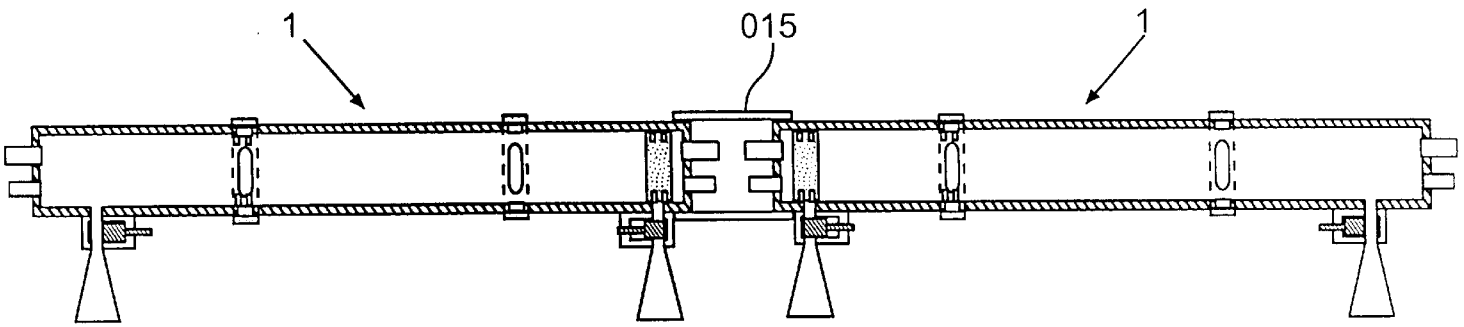
FIG. 7 is a configuration of engines in tandem to eliminate reactive cylinder movements.

FIG. 7 illustrates a tandem engine design in which two engines 1 are mounted back to back as shown. A tandem configuration joining structure 015 is utilized to affix the two engines 1 to each other in the tandem configuration. In the tandem configuration fuel injection and ignition are synchronized to eliminate reactive engine movements. This synchronization may be accomplished via conventional rack and pinions, linkages, gears, or other mechanical means. Of course, the tandem design may also include a reverse thrust arrangement like the one shown in FIG. 6.

Figure 8:
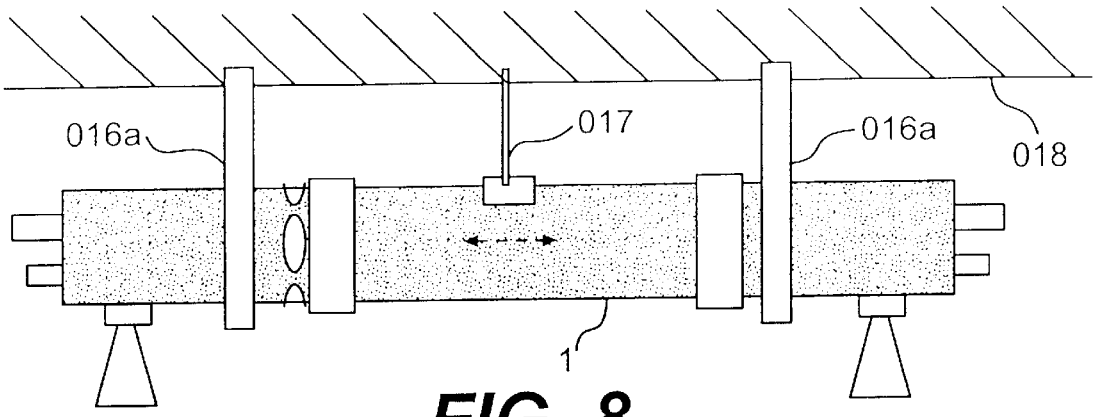
FIG. 8 shows a spring centered, slidably mounted engine to allow reactive movements.

FIG. 8 shows a spring centered, slidably mounted engine to allow reactive movements. In other words, the atmospheric propulsion engine can be slidably mounted to a vehicle structure 018 via slidable engine mounts 016*a* and 016b and a centering spring mechanism 017 as shown in FIG. 8. In this way, the engine 1 can traverse a small distance back and forth with slidable engine mounts 016*a*, 016*b* and centering spring mechanism 017 compensating for reactive forces generated by the engine 1.

Figure 9:
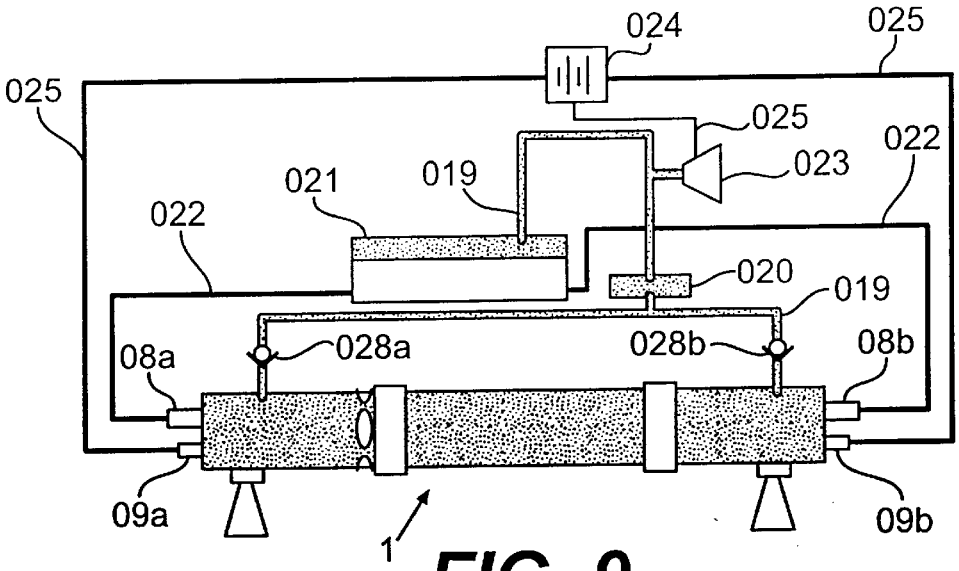
FIG. 9 is a schematic of an integrated atmospheric propulsion system with fuel, compressed air, and electrical components.
Figure 10:
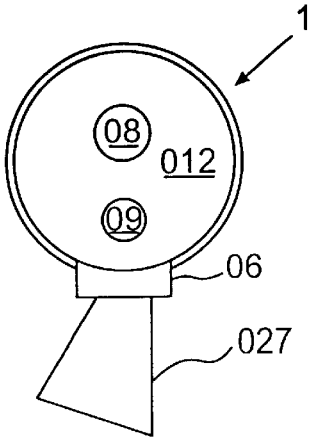
FIG. 10 PRIOR ART
FIG. 10 shows a conventional swivel nozzle concept that may be utilized in conjunction with the inventive engine.
Figure 11:
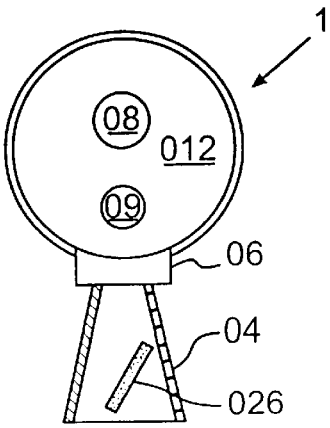
FIG. 11 PRIOR ART
FIG. 11 shows a conventional jet vane concept that may be utilized in conjunction with the inventive engine.

FIG. 9 is a schematic showing how the unicycle engine indicated by reference 1 can be integrated into an operating system containing adjunct fuel and electrical systems. Gas lines 019 with check valves 028*a* and 028*b* are picked off of cylinder 02 to pressurize high pressure gas reservoir 020 and feed the pressurized fuel tank 021 and turbine generator 023. The fuel lines 022 feed fuel to fuel injectors 08*a* and 08*b*. Turbine generator 023 charges battery and electronics package 024 which transmits a timed firing signal to igniters 09*a* and 09*b* at the predetermined event time through electrical lines 025. Appropriate. sensors may be utilized to sense the position of the piston via obturation of ports 07*a*, 07*b*, 011*a*, and 011*b* so that the actuators 013*a*, 013*b*, 014*a*, 014*b* as well as the fuel injectors 08*a*, 08*b* and igniters 09*a*, 09*b* can be activated at the correct timing relationship that is described above. These sensors and activators may be, for example, electrical or pneumatic.

Description of Second Embodiment

Figure 12:
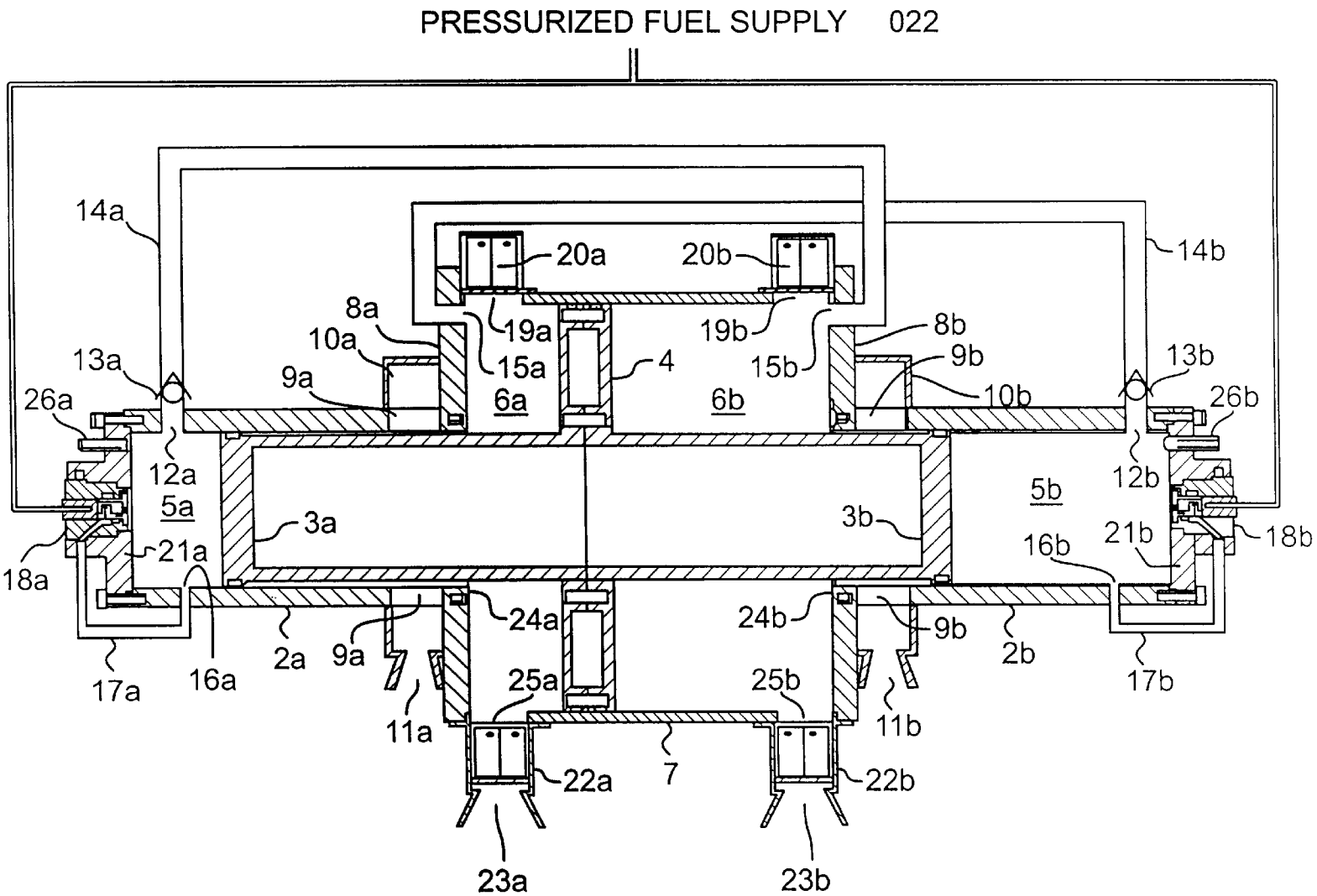
FIG. 12 is a schematic cross section of a second embodiment of the inventive engine.

Referring to FIG. 12, the primary elements of a second embodiment of the invention which is essentially a free piston intermittent pulse rocket engine includes two combustion cylinders, 2*a* and 2*b*, coaxially located within, and separated by, a thrust chamber cylinder 7. The combustion pistons 3*a*, 3*b* and thrust piston 4 are connected and slidably inserted into cylinders 2*a*, 2*b*, and 7 respectively, forming combustion chambers 5*a*, 5*b* and thrust chambers 6*a*, 6*b*. Intake check valve assemblies 20*a*, 20*b* provide a valved inlet for air into thrust chambers 6*a*, 6*b* via thrust intake ports 19*a*, 19*b*.

The opposing ends of combustion cylinders 2*a*, 2*b* are closed by cylinder heads 21*a*, 21*b* that contain fuel injectors 18*a*, 18*b*, respectively. Fuel injectors 18*a* and 18*b* are fed by the pressurized fuel supply line 28. The opposing ends of thrust chambers 6*a*, 6*b* are closed by thrust chamber flanges 8*a*, 8*b*.

Injector control gas ports 16*a*, 16*b* are provided in cylinders 2*a*, 2*b* and are connected to injector gas control lines 17*a*, 17*b*, respectively. The other ends of injector gas control lines 17*a*, 17*b* are, in turn, connected to fuel injectors 18*a*, 18*b*. As further described below, injector control gas ports 16*a*, 16*b* activate fuel Injectors 18*a*, 18*b* as combustion pistons 3*a*, 3*b* cross respective injector control gas port 16*a*, 16*b* while moving on the compression stroke.

Exhaust ports 9*a*, 9*b* formed in combustion chambers 2*a*, 2*b* allow for expulsion and scavenging of burnt combustion gases via exhaust ducts 10*a*, 10*b* and exhaust thruster nozzles 11*a*, 11*b*. Scavenge purge lines 14*a*, 14*b* allow high pressure air from thrust chambers 6*b*, 6*a* to scavenge combustion chambers 5*a*, 5*b* through scavenge ports 12*a*, 12*b* and scavenge inlet ports 15*a*, 15*b*, when pistons 3*a*, 3*b* opens combustion chambers 5*a*, 5*b* to exhaust. Scavenge port check valves 13*a*, 13*b* prohibit counter-flow during the combustion, expansion and compression cycles of each combustion cylinder as further described below. Thrust chamber exhaust separators 24*a*, 24*b* ensure separation of exhaust from combustion chambers 5*a*, 5*b* to thrust chambers 6*a*, 6*b*.

Main thruster check valves 22*a*, 22*b* interconnect main thruster nozzles 23*a*, 23*b* with thruster ports 25*a*, 25*b* and thrust chambers 6*a*, 6*b*, respectively.

Pneumatic starter valves 26*a*, 26*b* allow compressed air from a compressed air source (not shown) to enter combustion chambers 5*a*, 5*b* and permit engine starting.

Operation of Second Embodiment Engine

Operation of the engine will be described here, while construction and operation of the preferred fuel injector 18 will be described in following paragraphs.

Figure 13:
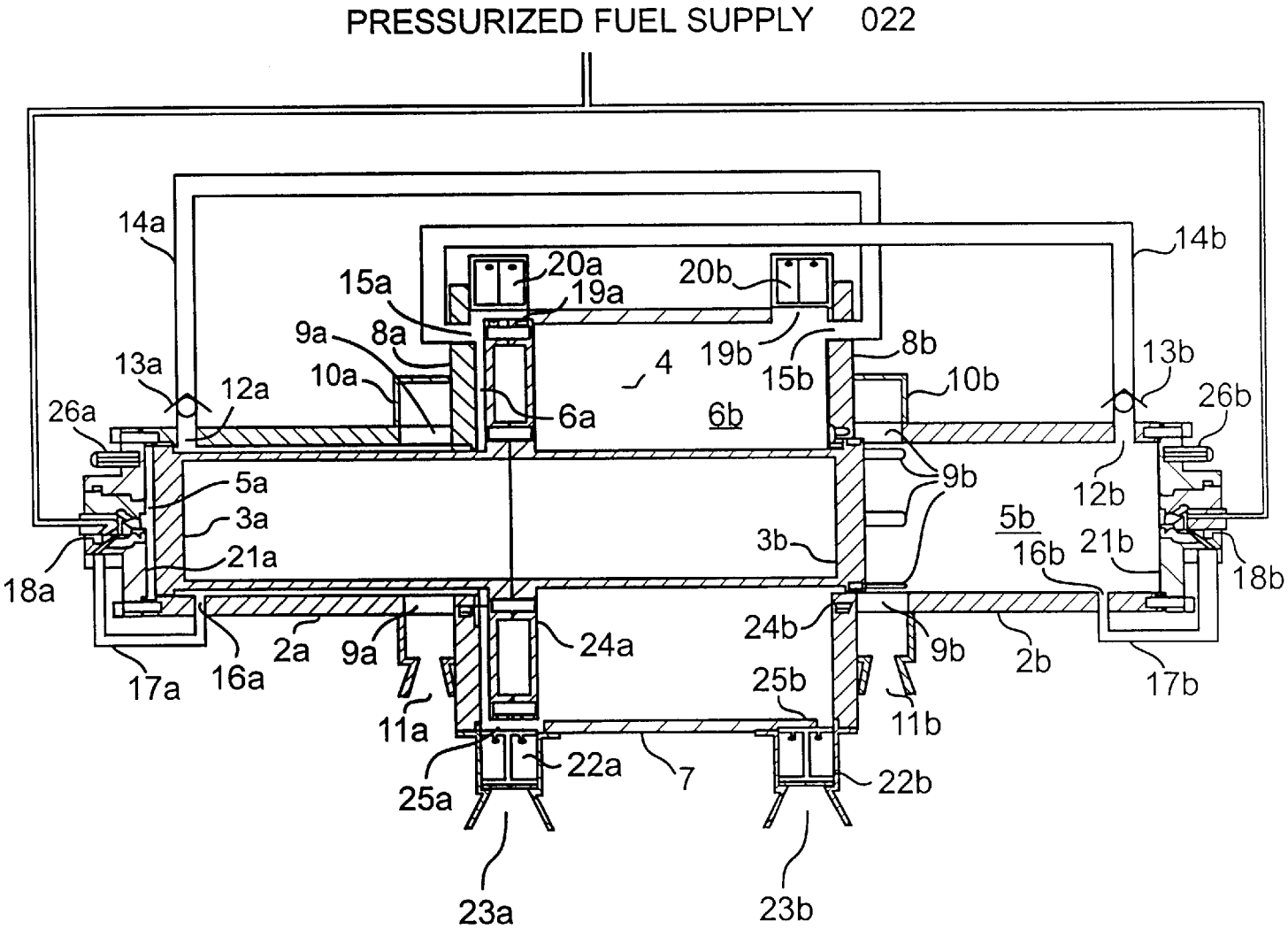
FIG. 13 is the schematic of FIG. 12, with the piston in firing position at the left end of the cylinder.

Assume that piston 3*a* is in its compression position to the left of cylinder 2*a* as shown in FIG. 13. When piston 3*a* is in its compression position, the volume of chamber 5*a* is at its minimum, and compression pressure therein is at a maximum. Fuel injection has been accomplished and combustion is underway. Piston 3*b* has opened chamber 5*b* to exhaust through ports 9*b*, exhaust duct 10*b* and exhaust nozzle 11*b*. Thrust chamber 6*a* has completed expulsion of its thrust gas and its pressure is approaching atmospheric. Thrust chamber 6*b* has completed its air intake stroke and is near atmospheric pressure. Injector gas control port 16*a* is at atmospheric pressure through exhaust port 9*a*. Check valve 13*a* is closed since thrust chamber 6*b* is at low intake pressure.

As the combined piston (3*a*-4-3*b*) begins moving to the right under the impetus of compression pressure and fuel combustion, the following actions occur:

- Thrust chamber 6*a* begins intake of air through check valve 20*a*, while check valve 25*a* prevents entry of air through nozzle 23*a*.
- Pressure builds up in thrust chamber 6*b* with the subsequent expulsion of air and generation of thrust through thruster port 25*b*, check valve 22*b* and nozzle 23*b*. Check valve 20*b* prevents loss of air through the inlet port 19*b*.
- Piston 3*b* begins closure of cylinder 2*b* exhaust ports 9*b*.

Figure 14:
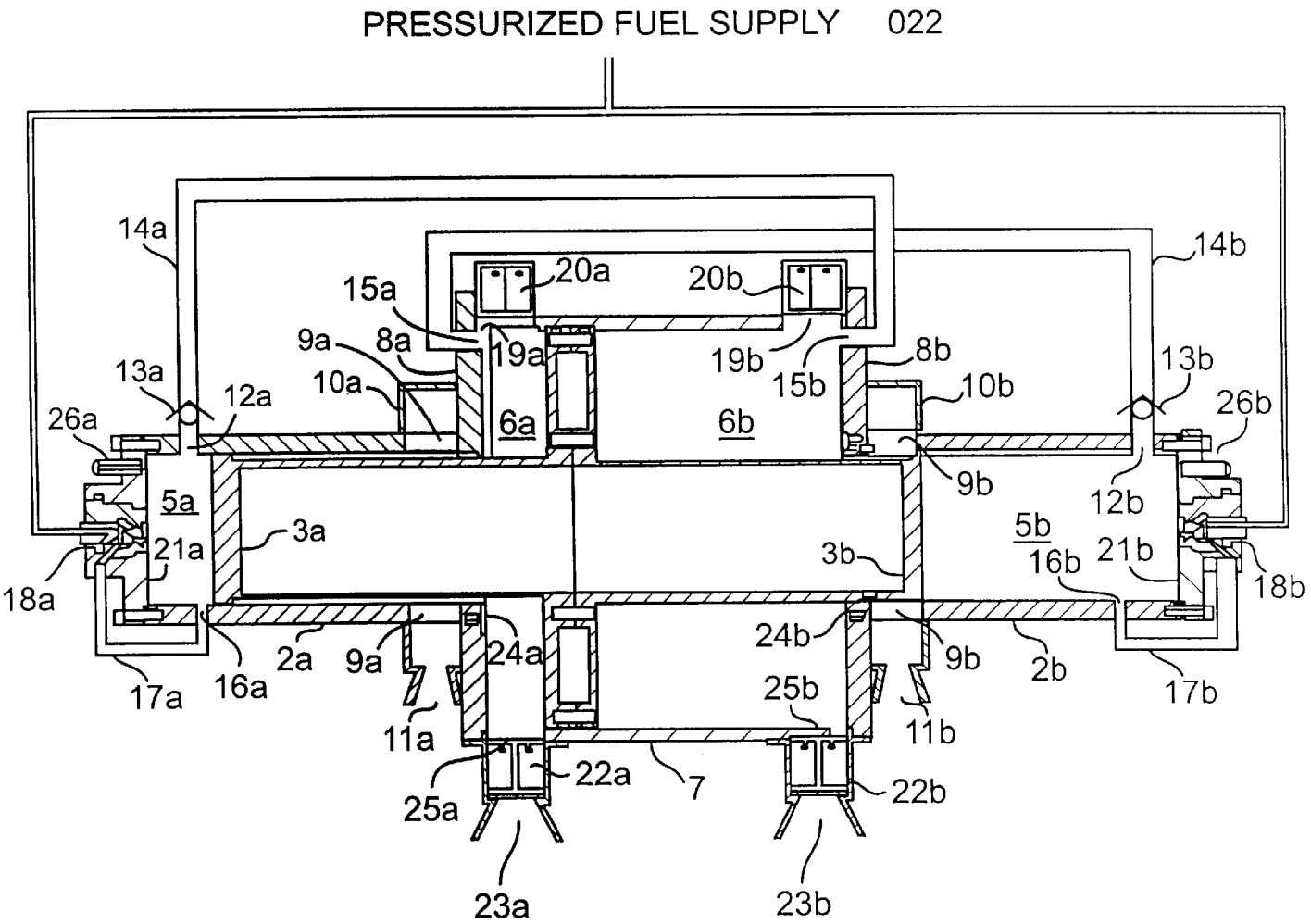
FIG. 14 is the schematic of FIG. 12 with the combustion in the left combustion cylinder in progress.

As shown in FIG. 14, when the combined piston (3*a*-4-3*b*) has moved right to the point where piston 3*b* has closed cylinder 2*b* exhaust ports 9*b*, the following actions have taken place or now occur:

- Piston 3*b* begins compression of the combustion air in chamber 5*b*.
- Piston 3*a* has uncovered scavenge port 12*a*, but check valve 13*a* prevents any flow.
- Piston 3*a* has uncovered injector gas control port 16*a* and reset of the injector 18*a* for the next cycle has begun. This will be explained in a following paragraph describing injector operation.
- Expansion of combustion gas in chamber 5*a* is increasing the velocity of piston 3*a*-4-3*b* to the right.
- Under the impetus of piston 4, pressure is increasing in chamber 6*b*, with the resultant increase of mass flow and thrust out of nozzle 23*b*.
- Chamber 6*a* is ingesting atmospheric air through valve 20*a*.

Figure 15:
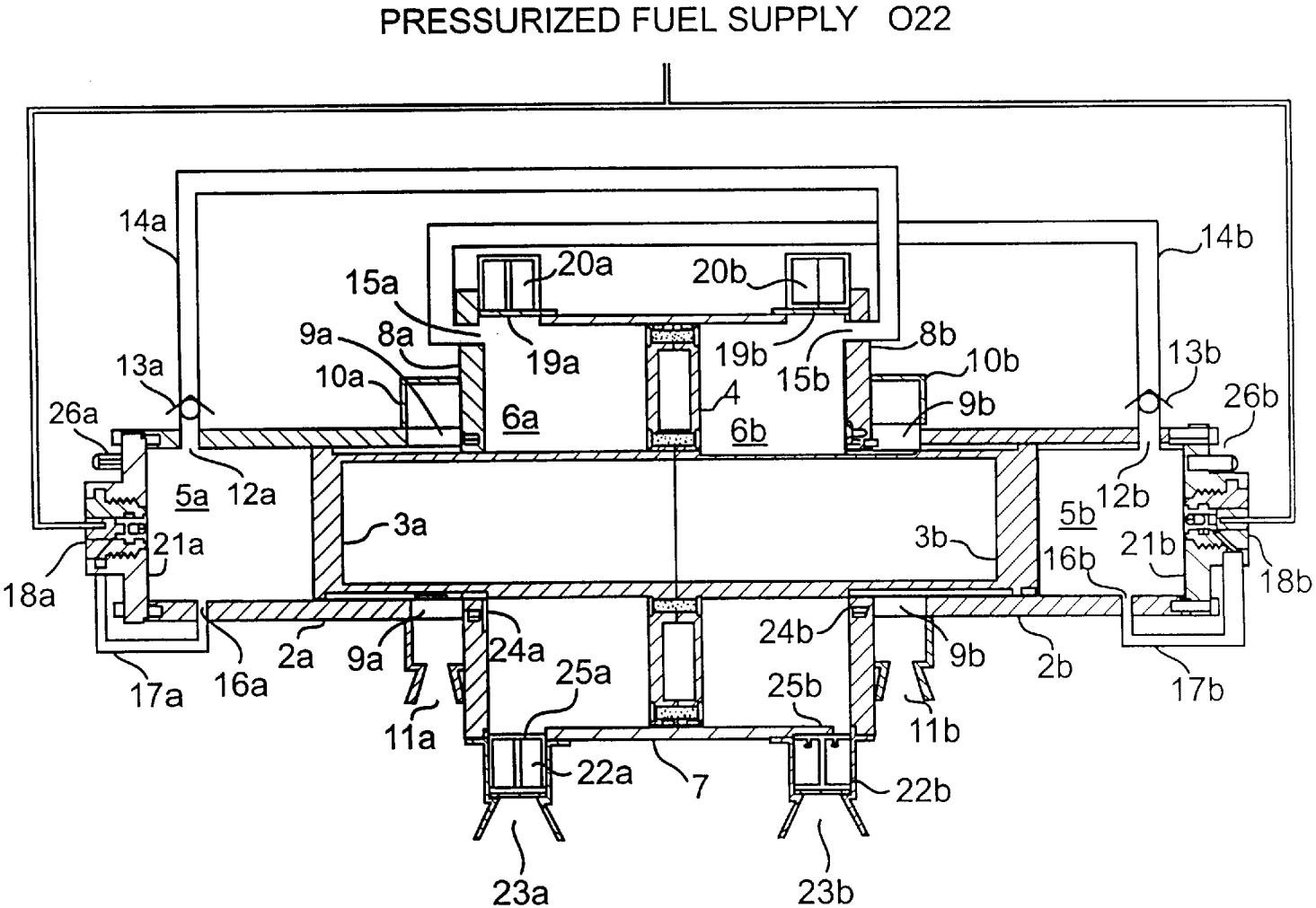
FIG. 15 is the schematic of FIG. 12 with the piston at the midpoint of its stroke and at maximum velocity.

As shown in FIG. 15, when piston 3*a* is around mid point of its stroke in cylinder 2*a*, its maximum velocity is attained, and it begins to decelerate due to the pressure degradation in chamber 5*a* and the opposing forces generated by the increase in pressures in chambers 6*b* and 5*b*.

Figure 16:
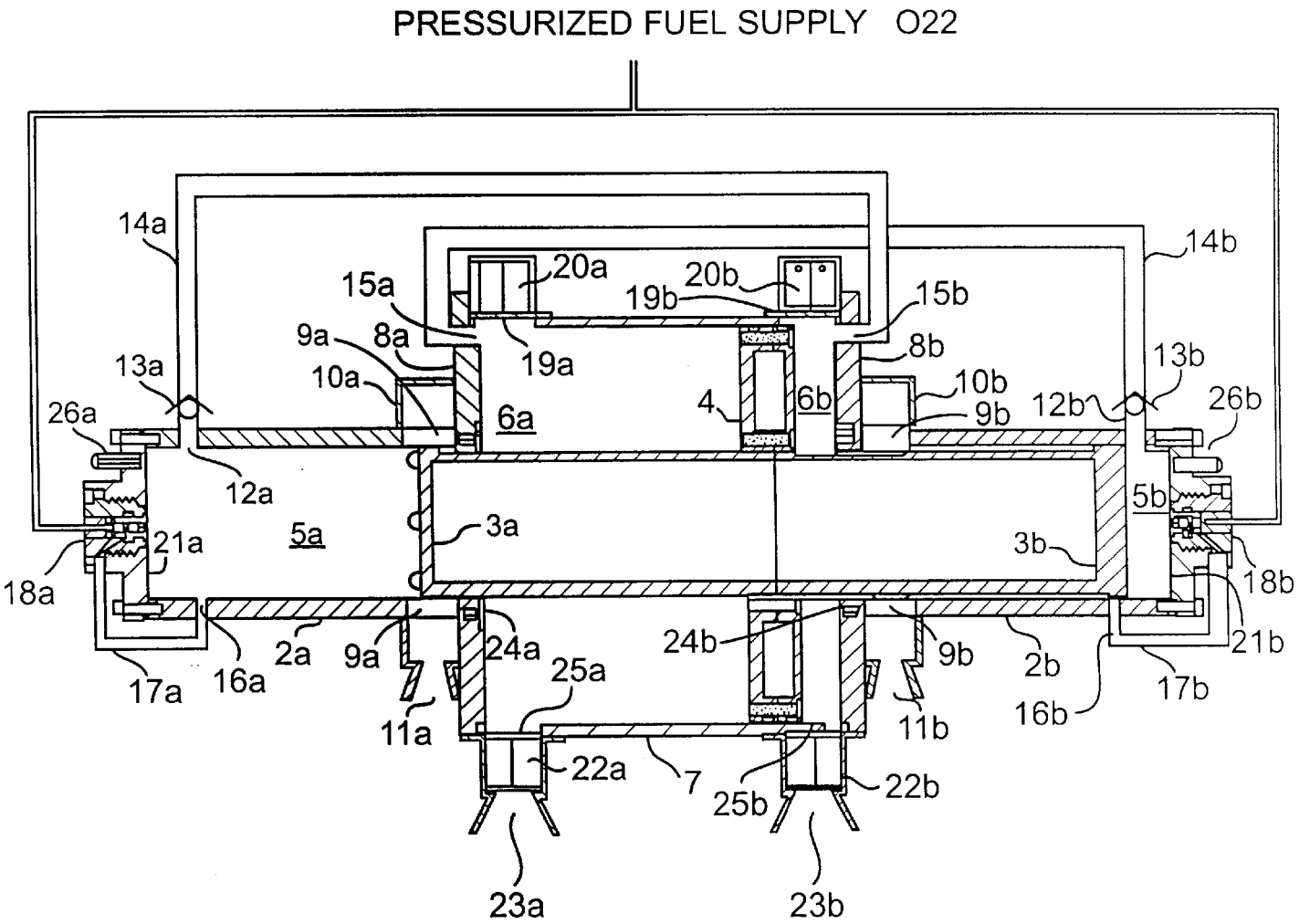
FIG. 16 is the schematic of FIG. 12 compressing the right combustion chamber.

As shown in FIG. 16, when piston 3*a* crosses exhaust ports 9*a*, the following events have taken place or now occur:

- Chamber 5*a* is vented to atmosphere through ports 9*a* and exhaust nozzle 11a, with some thrust generation.
- The pressure in chamber 5*a* drops below the pressure in chamber 6*b*, thus allowing fresh air from chamber 6*b* to enter chamber 5*a* through port 15*b*, line 14*a*, check valve 13*a*, and port 12*a*. This air then scavenges chamber 5*a* through exhaust ports 9*a* and exhaust nozzle 11*a*. Note that the scavenged air is not wasted, but used to generate thrust through exhaust nozzle 11*a*.
- Piston 3*b* is approaching the point of maximum compression in chamber 5*b*.
- Piston 3*b* has crossed injector gas control port 17*b* and communicated it with exhaust ports 9*b* and nozzle 11*b*.
- This begins activation of fuel injector 18*b*. This function will be explained in a paragraph describing injector operation.
- Chamber 6*b* is reaching maximum pressure, mass flow through check valve 25*b* and nozzle 23*b*, and is generating maximum engine thrust output.

Figure 17:
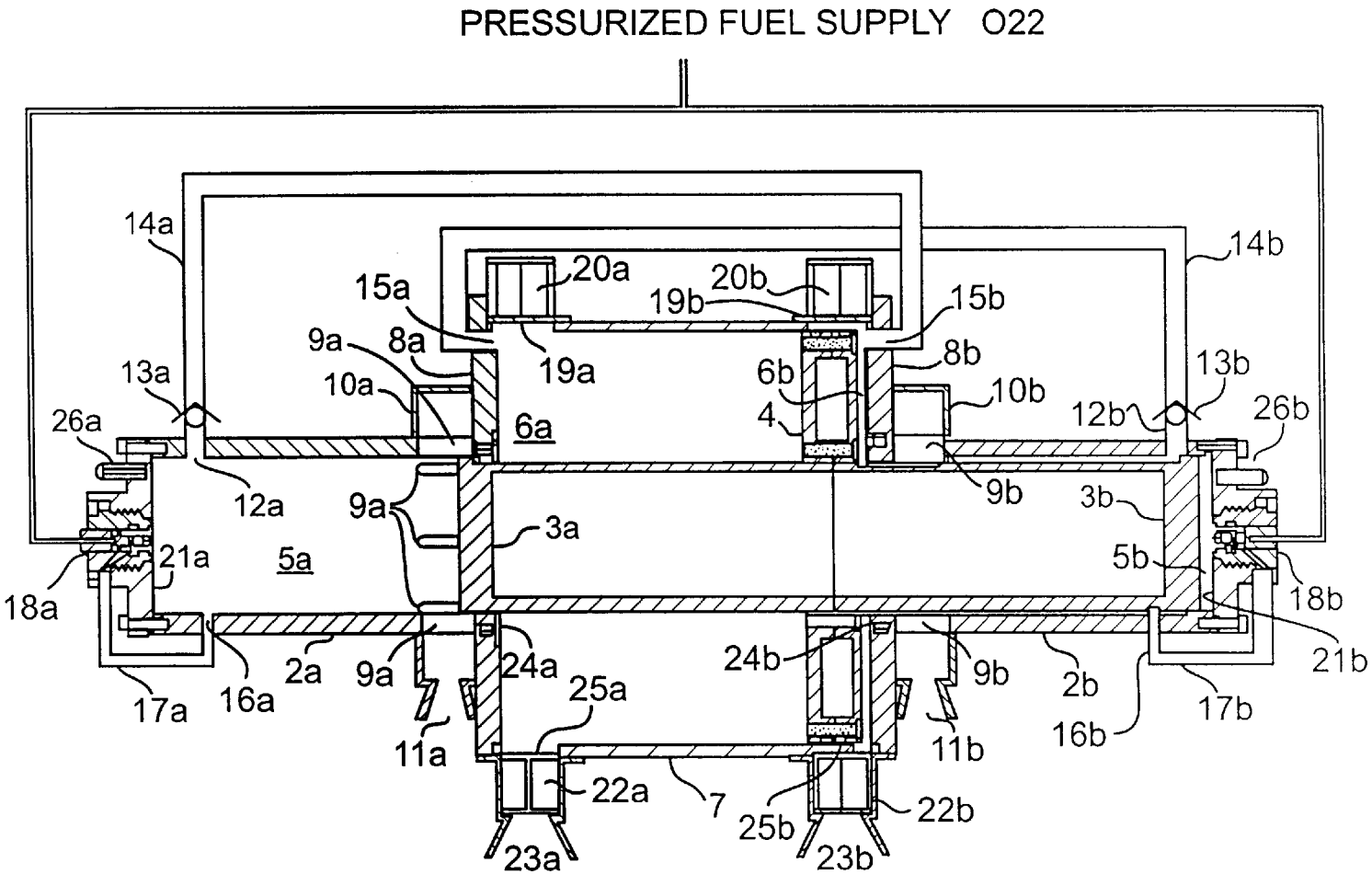
FIG. 17 is the schematic of FIG. 12 in firing position at the right end of the cylinder.

As shown in FIG. 17, the mass inertia of piston 3*a*-4-3*b* then carries it to the point of maximum compression pressure in chamber 5*b*, and its velocity reaches zero. At this time, the following conditions exist and the engine repeats the foregoing cycle in the opposite direction as follows:

- Fuel injector 18*b* is injecting fuel into combustion chamber 5*b* and combustion has begun.
- The pressure in thrust chamber 6*b* has decayed to atmospheric and scavenging of chamber Sa is complete, while chamber 5*a* remains open to exhaust and check valve 13*a* ceases interflow between 6*b* and 5*a*.
- Thrust chamber 6*a* has ingested its maximum volume of air and is at near atmospheric pressure.

Starting of the engine may be accomplished via pneumatic starter valves 26*a*, 26*b*. Specifically, a source of compressed air may be connected to at least one of the pneumatic starter valves 26*a* or 26*b*. For example, compressed air may be passed through pneumatic starter valve 26*a* and enter combustion chamber 5*a* thereby moving the piston (3*a*-4-3*b*) to the right until the operational state shown in FIG. 17 is achieved. At this point, the fuel injector 18*b* injects fuel into combustion chamber 5*b*, combustion begins, and the engine starts. Alternatively, a conventional igniter can be added to at least one of the cylinder heads 21*a*, 21*b* and utilized as a starting means with appropriate utilization of the pneumatic starter valves to inject compressed air to move the combined piston 3*a*-4-3*b* to a desired position, actuate a fuel injector 18 and thereby start the engine. Furthermore, pneumatic starter valves could also be added to the engine 1 of the first embodiment as an alternative method of starting that engine.

Furthermore, the system shown in FIG. 9 can be utilized with the engine of the second embodiment as indicated by the common usage of pressurized fuel line 022.

Fuel Injector

Figure 18:
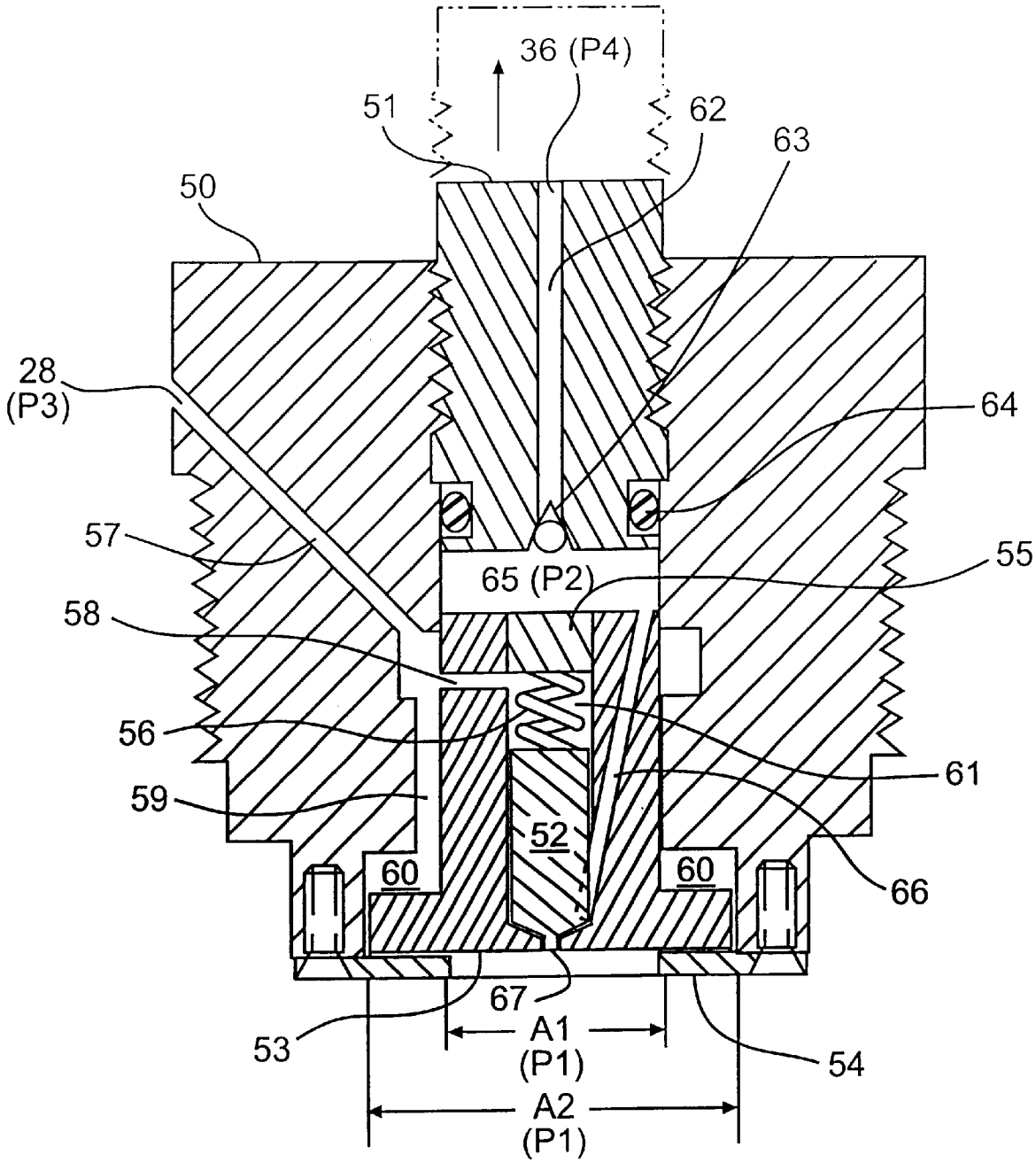
FIG. 18 is a schematic of an inventive self-actuated fuel injector that may be utilized with the second embodiment of the inventive engine.

The engine of the second embodiment is preferably equipped with the fuel injector shown in FIG. 18. For ease of reference, fuel injectors 18*a* and 18*b* will be collectively referred to as fuel injector 18 it being understood that the same fuel injector 18 design is used for both 18*a* and 18*b*.

As shown in FIG. 18, the self-actuated, uniaxial fuel injector 18 consists of an injector body 50 into which is slidably mounted an intensifier piston 53 containing a slidably mounted fuel pintle 52, closure spring 56, and pintle stop 55. All of these elements are coaxially located. An annular intensifier piston cylinder stop 54 is attached on the combustion chamber side of the injector body 50 to constrain motion of the intensifier piston 53. On the opposite end, a fuel quantity plug and stop 51 with seal 64 is centrally located and threadably inserted into the injector body 50.

The fuel quantity plug and stop 51 contains the pressurized fuel inlet connection 36, fuel inlet passage 62, and check valve 63. The check valve 63 allows fuel to flow into the fuel cavity 65 when the cylinder pressure PI is less than the inlet fuel pressure P4, enabling the fuel cavity 65 to refill and reset the intensifier piston 53 when the combustion cylinder enters the exhaust phase. The threaded insertion of the fuel quantity and plug 51 into the injector body 50 allows for simple adjustment of the amount of fuel metered for each injection cycle.

When installing the fuel injector 18, the pressurized fuel inlet connection is connected to pressurized fuel line 022.

Operation of Fuel Injector

The fuel injector 18 accomplishes the following functions: meter the amount of fuel required for a single combustion action; contain that fuel until injection is required; multiply the fuel injection pressure by the ratio of A1 to A2 above the cylinder compression pressure; inject the fuel into the combustion chamber when the engine piston crosses the gas control port; reset the pintle and intensifier piston, and refill the injector for the next cycle.

Refer to FIGS. 12 and 18 and assume that injector 18 is filled with fuel (fuel cavity 65 and passages 62 and 66) and ready to perform the injection function. As pressure (P1) rises in the cylinder chamber 5 during compression, the control gas inlet 28 (P3) and chambers 58, 60 and 61 track this pressure through gas control port 16 and injector gas control line 17 until piston 3 crosses gas control port 16.

During this period, the annular volume and area 60 (P3) is at the same pressure as the compression chamber 5 (P1), thus, that portion of A2 is counterbalanced and the effective area under P1 is equal to A1. Since the top area of the slidable intensifier piston 53 in contact with the incompressible fuel in fuel cavity 65 is also equal to A1, the pressure in fuel cavity 65 (P2) is equal to P1. Also, since the gas control pressure P3 is communicated to control gas pintle cavity 61, the areas and pressures on top and bottom of the pintle 52 being equal, this allows the pintle closing spring 56 to maintain the pintle 52 in the closed position, thus preventing fuel flow into the cylinder chamber 5.

When the piston 3 has crossed gas control port 16, control gas inlet 28 (P3), passage 57 and chambers 58, 60, and 61 are vented to atmosphere through injector gas control line 17, gas control port 16, exhaust port 9, and exhaust nozzle 11. When this occurs, the effective area of the intensifier piston 53 exposed to the compression pressure P1 is now equal to A2, while the effective area on the opposite end in contact with the fuel in cavity 65 (P2) is still equal to A1. Thus, the fuel injection pressure P2 increases in the ratio of A2 to A1 ($P1 \times A2 = P2 \times A1$). This pressure increase is consistent with the operation of a conventional intensifier piston.

Figure 19:
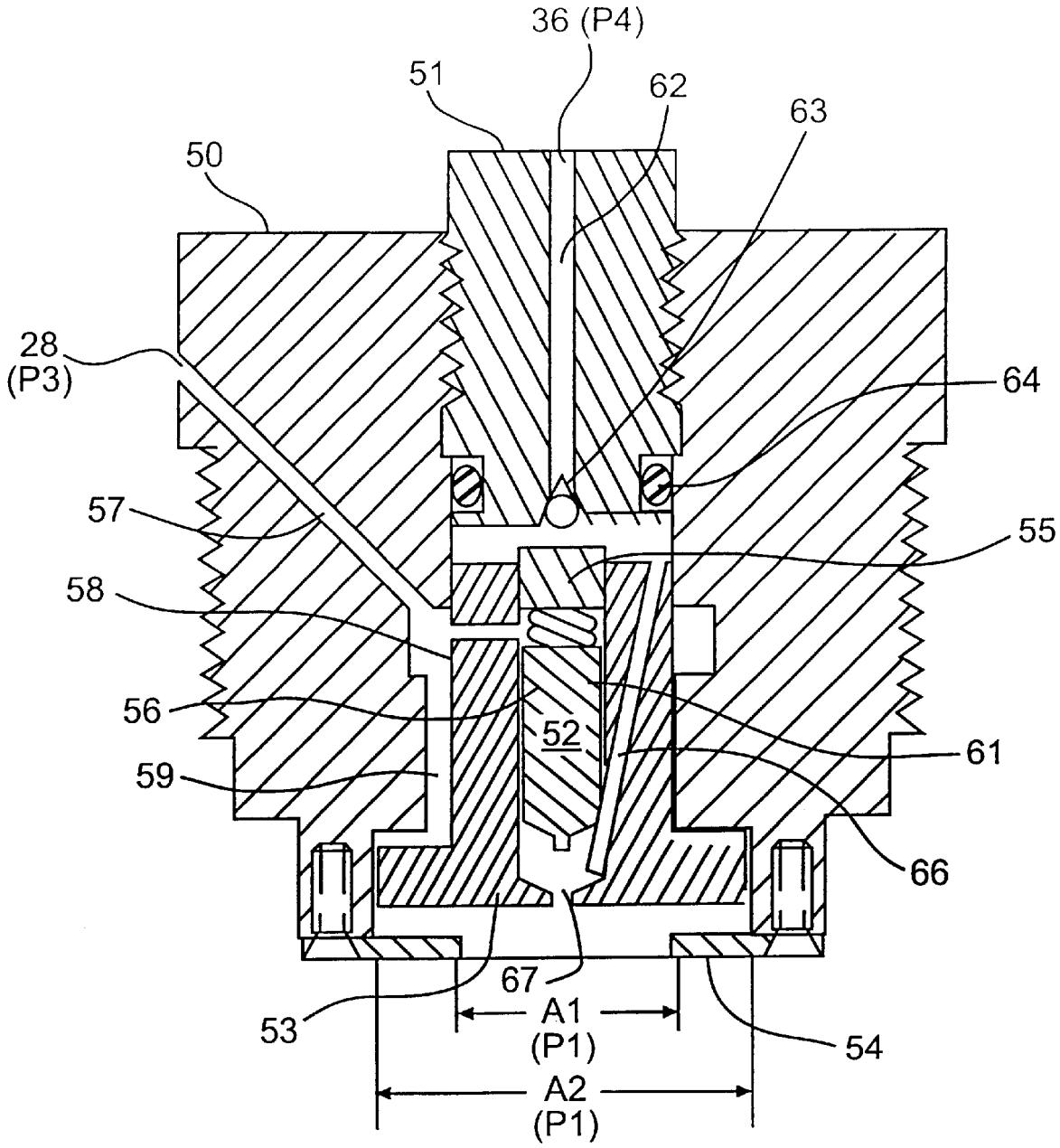
FIG. 19 is a schematic of the inventive self-actuated fuel injector of FIG. 18 during an injection phase of operation.

Typically, a cylinder compression pressure P1 of 1000 psi, might yield a fuel injection pressure P2 of 4000 psi, but this can be tailored for any specific design by appropriately adjusting, for example, A2 and A1. At the same time, the release of pressure in pintle cavity 61 allows compression pressure P1 and the increased fuel injection pressure P2 to act on the pintle 52 nose at injection nozzle 67, overcoming the force of the pintle closing spring 56 and causing the pintle to snap open. Fuel is now injected into combustion chamber 5 at pressure P2 until the fuel cavity 65 is depleted and the intensifier piston 53 contacts fuel quantity stop and plug 51 as shown in FIG. 19. Pressure P2 then drops to the more benign pressurized fuel inlet value P4, and any further fuel flow through the fuel delivery passage 66 is prevented by its inlet being in contact with the stop 51. This state and mechanical condition of fuel injector 18 remains constant until there is a change in the gas control pressure P3.

Figure 20:
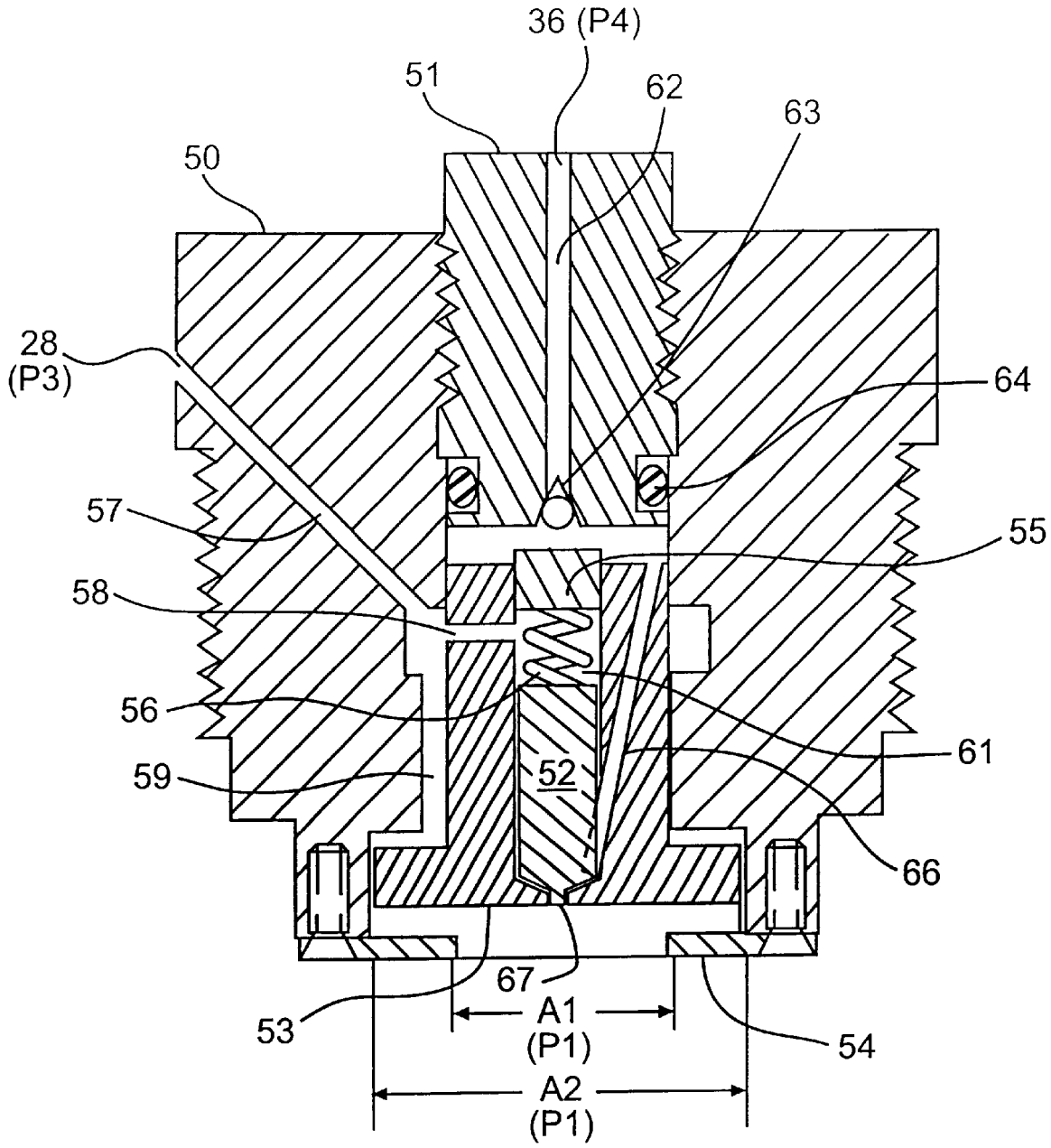
FIG. 20 is a schematic of the inventive self-actuated fuel injector of FIG. 18 during a reset phase of operation.

As piston 3 in cylinder 2 reverses direction for its power stroke under the impetus of compression pressure and combustion, piston 3 recrosses injector gas control port 16, again communicating control gas inlet 28 (P3) with combustion pressure P1 through injector gas control port 16 and gas control line 17. Gas control chambers 58, 60, and 61 then rise pressures equal to P1. Pintle 52 now has equal pressures on both ends, therefore, the pintle closing spring 56 causes the pintle 52 to return to its closed position as shown in FIG. 20, expelling any residual fuel in its cavity. Intensifier piston 53, however, has an effective area of A1 exposed to pressure P1, and since P1 is much higher than the fuel supply pressure P4, intensifier piston 53 will remain against stop 51 until piston 3 uncovers exhaust ports 9, and P1 in combustion member 5 decays to near atmospheric pressure. At this point, the fuel supply pressure P4 is greater than the chamber 5 pressure P1, fuel cavity 65 refills until intensifier piston 53 reaches piston cylinder stop 54. The fuel injector 18 is now reset, primed and ready for the next injection cycle.

The invention being thus described, it will be obvious that the same may be varied in many ways. Such variations are not to be regarded as departure from the spirit and scope of the invention, and all such modifications as would be obvious to one skilled in the art are intended to be included within the scope of the following claims.

What is claimed is:

1. A fuel injector comprising:

an injector body having a control gas passage, the control gas passage receiving a control gas pressure;

a fuel quantity plug/stop inserted into a first end of said injector body;

an intensifier piston having a fuel injector nozzle, said intensifier piston slidably disposed within said injector body between a first position in which a fuel cavity is formed between said intensifier piston and said fuel quantity plug/stop and a second position in which a volume of the fuel cavity is reduced;

said fuel quantity plug/stop including a fuel inlet passage in fluid communication with the fuel cavity;

said intensifier piston further including a control gas pintle cavity axially formed therein and a pintle cavity control gas passage in fluid communication with said control gas passage;

a intensifier piston stop provided at a second end of said injector body and preventing said intensifier piston from coming out of said injector body;

an intensifier piston control gas passage providing fluid communication between said control gas passage and said intensifier piston;

a pintle slidably disposed within said intensifier piston;

a pintle closing spring provided in said control gas pintle cavity and biasing said pintle against said fuel injector nozzle; and a fuel delivery passage provided in said intensifier piston and interconnecting the fuel cavity and said pintle.

2. The fuel injector according to claim 1, wherein a fuel injection pressure P2 in said fuel cavity is increased by a ratio of A2/A1 and ejected at the increased pressure from said fuel injector nozzle, where A2=area of a first end of said intensifier piston and A1=area of a second end of said intensifier piston.

3. The fuel injector according to claim 1, said intensifier piston further including a first end of a first diameter and first area A1 and a second end of a second diameter and a second area A2, the second diameter being larger than the first diameter and the second area A2 being larger than the first area A1;

wherein the different diameters of said intensifier piston are slidably disposed within corresponding bores in said injector body.

4. The engine according to claim 3, wherein the control gas pressure is control gas pressure P3, said intensifier piston stop being an annular member;

said control gas passage including an annular passage formed between said injector body and said intensifier piston at least when said intensifier piston is in the first position;

said first end of said intensifier piston being exposed to a fuel pressure P2 over area A1 from said fuel cavity;

wherein when the fuel injector is installed in an engine, said second end of said intensifier piston is exposed to a combustion chamber pressure P1 over area A2 from a combustion chamber;

said control gas passage receiving the control gas pressure P3 and communicating the control gas pressure P3 to said intensifier piston control gas passage, said pintle cavity control gas passage, and said control gas pintle cavity thereby applying the control gas pressure P3 to said intensifier piston and said pintle;

wherein said intensifier piston is in the first position when the control pressure P3 is substantially equal to pressure P1;

wherein said intensifier piston moves to the second position when the control pressure P3 drops to near atmospheric pressure thereby increasing an effective area of the second end of said intensifier piston to A2 and thereby increasing fuel pressure P2 by a ratio of A2/A1;

wherein when the drop in the control gas pressure P3 to near atmospheric pressure allows pressure P1 and increased pressure P2 to act on said pintle and overcome the bias applied by said pintle closing spring thereby causing said pintle to open and fuel to be ejected at pressure P2A2/A1 until said fuel cavity is depleted and said intensifier piston contacts said fuel quantity plug/stop.

5. The fuel injector according to claim 4, said fuel inlet passage having a check valve therein;

said fuel inlet passage receiving fuel at a pressure of P4;

wherein after ejection of the fuel, pressure P2 drops to pressure P4 and further fuel flow through said fuel delivery passage is blocked by said check valve.

6. The fuel injector according to claim 5, wherein restoration of the control gas pressure P3 to pressure P1 causes the fuel injector to reset.

7. The fuel injector according to claim 1, further comprising:

a seal located between said fuel quantity plug/stop and said injector body;

said fuel quantity plug/stop having a threaded connection with said injector body permitting said fuel quantity plug/stop to be rotated into or out of said injector body and thereby adjust a volume of said fuel cavity and a quantity of fuel to be injected.

* * * * *